US011340043B2

(12) United States Patent
Raulynaitis

(10) Patent No.: US 11,340,043 B2
(45) Date of Patent: May 24, 2022

(54) VERTICAL EXPLOSIVE REACTIVE ARMOR, THEIR CONSTRUCTION AND METHOD OF OPERATION

(71) Applicant: MB „IDERIKA", Karmėlava (LT)

(72) Inventor: Erikas Raulynaitis, Karmėlava (LT)

(73) Assignee: MB „IDERIKA", Karmėlava (LT)

( * ) Notice: Subject to any disclaimer, the term of this patent is extended or adjusted under 35 U.S.C. 154(b) by 0 days.

(21) Appl. No.: 17/269,141

(22) PCT Filed: Jul. 19, 2019

(86) PCT No.: PCT/IB2019/056186
§ 371 (c)(1),
(2) Date: Feb. 17, 2021

(87) PCT Pub. No.: WO2021/014186
PCT Pub. Date: Jan. 28, 2021

(65) Prior Publication Data
US 2021/0325150 A1 Oct. 21, 2021

(51) Int. Cl.
*F41H 5/007* (2006.01)

(52) U.S. Cl.
CPC ..... *F41H 5/007* (2013.01)

(58) Field of Classification Search
CPC ..... F41H 5/007; F41H 5/04; F41H 7/04
See application file for complete search history.

(56) References Cited

U.S. PATENT DOCUMENTS 4,368,660 A 1/1983 Held
5,070,764 A 12/1991 Shevach et al.
5,206,451 A 4/1993 Bocker
(Continued)

FOREIGN PATENT DOCUMENTS

CN 1755317 A 4/2006
EP 2040024 B1 3/2015
(Continued)

OTHER PUBLICATIONS

International Search Report for PCT/IB2019/056186 dated Mar. 10, 2020 (three pages).
(Continued)

*Primary Examiner* — J. Woodrow Eldred
(74) *Attorney, Agent, or Firm* — Tutunjian & Bitetto, P.C.

(57) ABSTRACT

Vertical explosive reactive armor (VERA) include: an explosive material, an inert plate, a damping material, a casing; a casing cover and a casing upper limiter. VERA additionally could have an expandable material and an uneven surface inert plate. The essential component of VERA is the casing upper limiter, the purpose of which is to hold back the part of the inert plate after the detonation, which makes the inert plate to bend at an angle. Bent back inert plate is breaking kinetic penetrator by its plane into individual elements and affects the trajectory of the kinetic penetrator. If the penetrator is explosively formed penetrator, the inert plate shatters or partially destroys the integrity of the current of the penetrator by its own plane. Such VERA construction protects against kinetic penetrators, explosively formed penetrators and tandem explosively formed penetrators. These VERA are efficient, compact, easy to manufacture and operate.

10 Claims, 2 Drawing Sheets

(56) References Cited

U.S. PATENT DOCUMENTS

| | | | | |
|---|---|---|---|---|
| 5,293,806 | A | 3/1994 | Gonzalez | |
| 2007/0039837 | A1* | 2/2007 | Hanina | F41H 5/023 206/204 |
| 2011/0138993 | A1* | 6/2011 | Mariotti | F41H 5/007 89/36.02 |

FOREIGN PATENT DOCUMENTS

| | | | |
|---|---|---|---|
| PL | 156463 | B1 | 3/1992 |
| WO | 87/05993 | A1 | 10/1987 |
| WO | 94/20811 | A1 | 9/1994 |
| WO | 01/59396 | A1 | 8/2001 |

OTHER PUBLICATIONS

Written Opinion of ISA for PCT/IB2019/056186 dated Jan. 28, 2021 (five pages).

* cited by examiner

VERTICAL EXPLOSIVE REACTIVE ARMOR, THEIR CONSTRUCTION AND METHOD OF OPERATION

TECHNICAL FIELD OF THE INVENTION

The present invention, in general, relates to the field of explosive reactive armor. This particular invention describes vertical explosive reactive armor, their construction and method of operation.

DISCUSSION OF BACKGROUND ART

Military vehicles usually have armors to withstand the impact of penetrators, such as shrapnel, bullets or missiles. There are two main types of penetrators: kinetic energy penetrator (KEP) and explosively formed penetrator (EFP). Nowadays tandem EFP are used frequently, consisting of two detonating cartridges: the first cartridge disrupts explosive reactive armor, whereas the second cartridge damages military vehicle. Military vehicles use explosive reactive armor (ERA), mounted on military vehicle, to protect against KEP and EFP. Such type of ERA should effectively protect military vehicles from KEP and EFP of different caliber. There are patents, describing ERA structure and method of operation, however, all of them have some drawbacks.

Document PL156463B1 (published 1992 Mar. 31) describes ERA, which is composed of one layer of explosive substance and one inert plate. These elements are inside the container, which is mounted on the military vehicle and which protects the composing elements from the environmental impact or from spontaneous explosion. When penetrator hits such ERA, explosive substance detonates and penetrator is destroyed or diverted, thus the efficiency of penetrator is decreased. The problem is that in order to effectively protect military vehicle from KEP and EFP, quite big amount of explosive substance is needed. Moreover, such type of ERA is ineffective against tandem EFP. Such type of ERA is also ineffective when it is mounted in a vertical position. However, the biggest surface area of military vehicle is exactly vertical. Therefore, such first-generation ERA is inefficient.

Documents WO/1987/005993 (published 1987 Oct. 8) and U.S. Pat. No. 4,368,660A (published 1983 Jan. 18) describes ERA, intended for use against EFP. ERA is composed of a layer of an explosive substance and a layer of a compressible material, which are enclosed between two metallic, parallel plates. All these elements are inside the container, which protects the composing elements from the environmental impact or from spontaneous explosion. When penetrator hits such ERA, explosive substance detonates. Due to the layers of explosive substance and compressible material, ERA has average or high density medium and small density medium, therefore different pressure shock waves appears. As a consequence, metallic plates separate and move into different directions. The liquid current of copper becomes unconcentrated, thus the effect of EFP on ERA highly decreases. In such a case, military vehicle is protected. The problem is that such type of ERA is functioning effectively when the metallic plates are leaned against the vertical position. When EFP hits perpendicularly to the vertical plates, the efficiency of the EFP is low. The maximum surface area of the military vehicle is precisely vertical. Secondly, such ERA is ineffective against tandem penetrators. Thirdly, a sufficiently large amount of explosive material is needed to effectively protect the military technique from KEP and EFP.

The patent document EP2040024B1 (published 2015 Mar. 18) describes ERA, consisting of plates, explosive substance, expandable material and container, containing all of the above-mentioned materials. In the case of this invention, ERA may contain additional plates, additional layers of explosive substance or expandable material. In addition, several containers may overlap with each other, container orientation to each other could be different. The effectiveness of such ERA is higher and such type of ERA is effective against tandem penetrators. However, another problem arises in this case. When fastening the plates to the military vehicle at a slope, in several rows or retracted from the military vehicle, it is an increase in the dimensions and weight of the military vehicle. ERA takes up a lot of space. Because military vehicle has a maximum size limit (for transporting military vehicle, moving under bridges, viaducts, etc.), this method is impractical. In addition, a large amount of explosive substance is required because many containers are used.

Document U.S. Pat. No. 5,070,764A (published 1991 Dec. 10), describes an invention in which ERA consist of several layers of explosive and expandable materials, present in one container. The layer of explosive material is external, thus the penetrator hits it firstly. In this case, when penetrator hits the container, explosive material detonates and the volume of expandable material increases, so the metal plate is thrown toward the penetrator. These processes disintegrate the concentration of the EFP current and reduces the blow of the kinetic penetrator. However, similar problems persist as in the previous inventions: in the case when containers are fastened at a slope to the vertical orientation or retracted from the military vehicle, it is an increase in the dimensions and weight of the military vehicle, ERA takes up a lot of space. Since only one layer of explosive material is used, the effectiveness of such ERA is low against the tandem penetrators.

At present, the main work for improving ERA is mainly performed combining different layers of explosive or expandable materials and improving the composition of these materials. However, the problem is still not solved: it is not possible to simultaneously increase the number of plates and explosive or layers of expandable material, while at the same time not increasing the size and the weight of the military vehicle. In addition, ERA is less effective against kinetic penetrators. The efficiency of ERA is greatest when their planes are inclined from the vertical, but most of the surfaces of the military vehicle are vertical. Thus, there is a need for vertically orientated ERA, which effectively protects against kinetic and tandem explosively formed penetrators and is compact.

This description provides a technical solution, which maximally solves the problem.

SUMMARY OF THE INVENTION

Vertical explosive reactive armor (VERA) comprises the following components: an explosive material, an inert plate, a damping material, a casing; a casing cover, an expandable material and a casing upper limiter. The essential component of VERA is the casing upper limiter, the purpose of which is to hold back the part of the inert plate after the detonation, which makes the inert plate to bend at an angle. Bent back inert plate is breaking kinetic penetrator by its plane into individual elements and affects the trajectory of the kinetic penetrator. If the penetrator is explosively formed penetrator, the inert plate shatters or partially destroys the integrity of the current of the penetrator by its own plane. Such VERA construction protects against kinetic penetrators, explosively formed penetrators and tandem explosively formed penetrators. These VERA are efficient, compact, easy to manufacture and operate.

Figure 1:
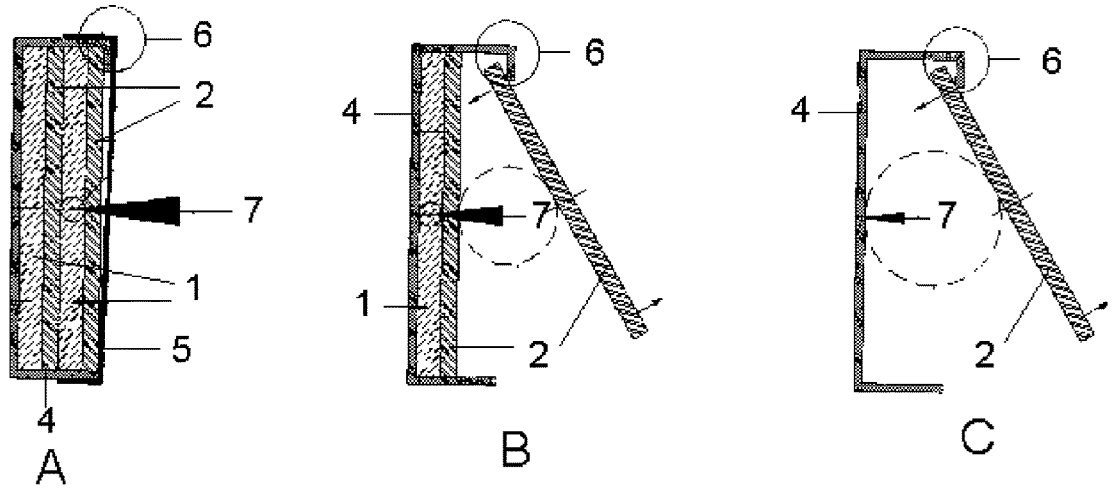
FIG. 1. Vertical explosive reactive armor (VERA) construction. A—not activated VERA, B—VERA after the contact with the penetrator (7), when the detonation of the first layer of the explosive material (1) occurred, C—VERA after the contact with the penetrator (7), when the detonation of the second layer of the explosive material (1) occurred.

The picture presents an illustration—the scale, proportions and other aspects do not necessarily correspond to the real technical solution.

DETAILED DESCRIPTION OF THE INVENTION

In order to protect the military vehicle from kinetic and explosively formed penetrators, explosive reactive armor (ERA) most commonly is used, which is mounted on the military vehicle. When ERA detonates, explosion wave, arising at the moment of the explosion, reduces the effectiveness of both kinetic and explosively formed penetrator. When ERA contains two layers of explosive materials and expandable materials, such ERA also protects against tandem explosively formed penetrators. The efficiency of ERA is highest when their planes are inclined from the vertical. However, most of the military vehicle surfaces are vertical. Thus, there is a need for vertical ERA, which would protect effectively against kinetic and tandem explosively formed penetrators and would be compact. This description provides a technical solution, which maximally solves the problem.

VERA is meant to protect the military vehicle against penetrator (7). A penetrator (7) is a projectile or missile of a different caliber, the purpose of which is to damage the military vehicle. There are two essential types of penetrators (7):

kinetic;
explosively formed.

A typical kinetic penetrator (7) is a high-density projectile, made of tungsten-steel or even uranium, which is moving at a speed of 1500-1800 m/s. Kinetic penetrator (7) damages military vehicle with kinetic energy, transmitted at the moment of the blow.

The working principle of the explosively formed penetrator (7) is based on the formation of a liquid copper current at the moment of explosion, which is capable of penetrating through the solid body at high speed (from 4000 to 10000 m/s). The operation of the explosively formed penetrator (7) is optimal when the formed liquid copper current is concentrated. Currently, the most effective explosively formed penetrators (7) are anti-armored rockets that use tandem explosively formed heads. I.e., the penetrator has two explosive cartridges: the first cartridge destroys the explosive reactive armor, whereas the second one violates the military vehicle. The main is the second cartridge, which has a much stronger explosive cartridge.

In a separate case, the penetrator (7) may be a projectile, rocket or other military cartridge of another caliber, capable of damaging the military vehicle.

The invention describes vertical explosive reactive armor (VERA), which comprise the following parts (FIG. 1-FIG. 4):

explosive material (1);
inert plate (2);
damping material (3);
casing (4);
casing cover (5);
casing upper limiter (6);
expandable material (8).

An explosive material (1) is a material or mixture of materials that detonates when a kinetic or an explosively formed penetrator (7) hits it. As an example, not limited to, there could be these explosive materials (1): hydrogen, HMX (High Melting Explosive), PETN (pentaerythritol tetranitrate), HNIW (hexanitrohexaazaisowurtzitane), octanitrocubane, TNT (trinitrotoluene), RDX (Hexogen) and others or their mixtures. As an example, not limited to, the mixture of explosive materials (1) can be so called mixture B, which consists of: 60% RDX, 39% TNT and 1% wax (here—% by weight). In a mixture of explosive materials (1), there could be some non-explosive materials—they are required to regulate the sensitivity of explosive material (1) mixture. The sensitivity of the mixture of explosive materials (1) must be adapted to the real military conditions: VERA must not be activated when it is fired by light artillery or other projectiles which do not cause serious damage to the armored vehicle. VERA may consist of one or more layers of explosive material (1). FIG. 1-FIG. 4 represent VERA, which have two layers of explosive material (1).

Figure 2:
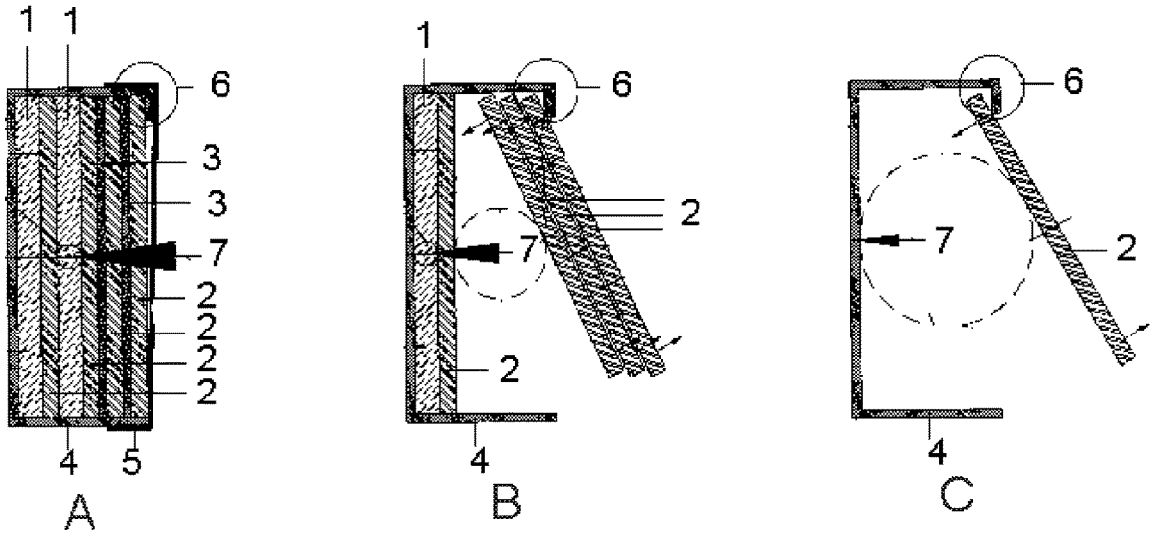
FIG. 2. Vertical explosive reactive armor (VERA) construction, a separate case. A—not activated VERA, B—VERA after contact with the penetrator (7), when the detonation of the first layer of the explosive material (1) occurred, C—VERA after contact with the penetrator (7), when the detonation of the second layer of the explosive material (1) occurred.
Figure 3:
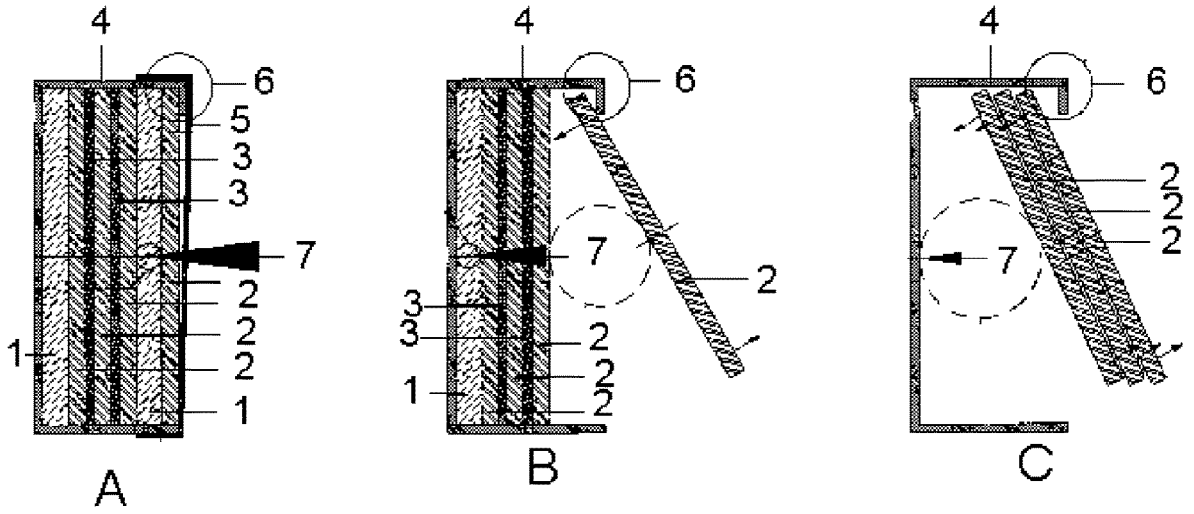
FIG. 3. Vertical explosive reactive armor (VERA) construction, a separate case. A—not activated VERA, B—VERA after the contact with the penetrator (7), when the detonation of the first layer of the explosive material (1) occurred, C—VERA after the contact with the penetrator (7), when the detonation of the second layer of the explosive material (1) occurred.
Figure 4:
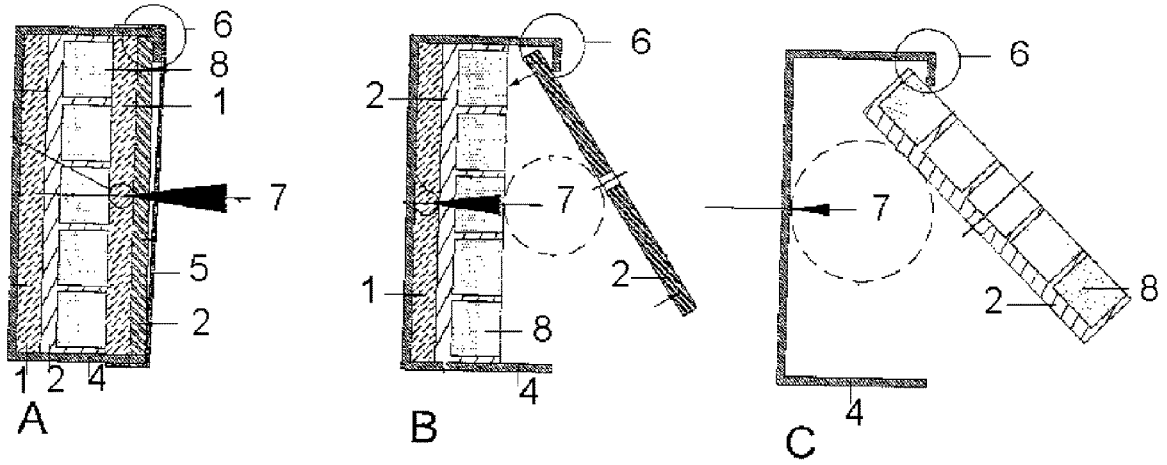
FIG. 4. Vertical explosive reactive armor (VERA) construction, a separate case. A—not activated VERA, B—VERA after the contact with the penetrator (7), when the detonation of the first layer of the explosive material (1) occurred, C—VERA after the contact with the penetrator (7), when the detonation of the second layer of the explosive material (1) occurred.

An inert plate (2) is a plate made of non-explosive material, resistant to light artillery or other projectiles, which do not cause serious damage to the military vehicle. An inert plate (2) usually has a flat plane (FIG. 1-FIG. 3). In one of the embodiment, an inert plate (2) may have plate-shaped elements that are perpendicular to the main plane (FIG. 4). These plate-shaped elements are rectangular in shape, their planes are perpendicular to the main plane. The plate-shaped elements are oriented in such a way that the plate-shaped elements and the edge of the casing upper limiter (6) main plane, which is closest to the open part of the casing (4), are parallel. The plate-shaped elements and the main plane can be an integral detail, or the plate-shaped elements can be separate components attached to the main plane of the plate through the edge of the plate-shaped elements. The plate-shaped elements are fixed to that side of the inert plate (2), from which a penetrator (7) arrives. An inert plate (2), which has plate-shaped element, hereinafter in the text will be referred to as an uneven surface inert plate (2). An inert plate (2) can be made of a variety of metals or their alloys (steel, rolled homogeneous armor (RHA), iron, aluminum, copper, etc.), synthetic materials (plastics, ceramics, etc.), natural materials (wood or other) or other non-explosive materials. The material from which the inert plate (2) is made must have an appropriate density. To ensure effective protection against kinetic penetrators (7), an inert plate (2) is made of durable material, such as rolled homogeneous armor. If a lightweight inert plate (2) is required, the lower density inert plate (2) is used (e.g., made of aluminum). Rolled homogeneous armor inert plates (2) are commonly used in the military vehicles. VERA may contain one or more inert plates (2). If VERA has several inert plates (2), their composition, dimensions or other characteristics may vary. For example, if VERA comprise four inert plates (2), they can be made of the same material, or can be made from different materials and have different properties. After detonation of the explosive material (1), the inert plate (2) bends at an angle and thus reduces the likelihood of penetration of the penetrator (7). The purpose of an inert plate (2): to protect military vehicle against environmental impact, to protect from light artillery, to partly protect against kinetic or explosively formed penetrator (7) and/or to weaken the shock wave formed during the detonation.

A damping material (3) is a material that reduces the sensitivity of the detonation. The damping material (3) can be made of polyurethane, rubber, glass fiber, basalt fiber and other natural or synthetic materials or mixtures thereof. When there is a damping material (3) in between the inert plates (2), several layers of inert plates (2) and damping material (3) are formed. Such construction reduces the likelihood of penetration of the penetrator (7) and helps the inert plates (2) to slip towards each other when, after contact with the penetrator (7), the inert plates (2) bend at an angle.

A casing (4) is a container, mounted on the military vehicle, which contains an explosive material (1), an inert plate (2), a damping material (3) or other elements of VERA. The casing (4) can be made of a variety of metals or their alloys (steel, iron, aluminum, copper, etc.), synthetic materials (plastics, ceramics, etc.), natural materials (e.g., wood, etc.) or other non-explosive materials. The walls of the casing (4) may be of different thickness: for example, the wall closest to the military vehicle may be thicker than the sidewalls. The material density of the casing (4) must be adjusted to the entire VERA construction and purpose. The casing (4) is mounted on the surface of the military vehicle. The construction of the casing (4) resembles a box, the basis of which is closest to the military vehicle, and the open part is on that side from which the penetrator (7) arrives. Thus, open part of the casing (4) is located the farthest from the military vehicle surface and is covered with a casing cover (5) (FIG. 1-FIG. 3). The function of the casing (4) is to protect VERA elements from the environmental impact, ensure VERA stability, protect against light artillery firing and partially protect against penetration of the penetrator (7).

A casing cover (5) is a structure made of non-explosive material, which covers the casing (4). The casing cover (5) can be made of a variety of metals or their alloys (steel, iron, aluminum, copper, etc.), synthetic materials (plastics, ceramics, etc.), natural materials (e.g., wood, etc.) or other non-explosive materials. The density of the casing cover (5) material should be adjusted to the whole VERA construction and purpose. The purpose of the casing cover (5) is to protect VERA elements, which are inside the casing (4), from the environmental impact, to ensure VERA stability and to partially protect against the light artillery firing.

The main detail of this invention is a casing upper limiter (6). The casing upper limiter (6) is a part of the casing (4), which is a plate-shaped in form, is present at the open side of the casing (4) and partly covers the inert plate (2). The casing upper limiter (6) is short, does not cover the entire casing (4) and is mounted on the casing (4) wall at an angle. The angle between the casing upper limiter (6) and the casing (4) wall can be varied, but the most common is 90 degrees. Most often, the casing upper limiter (6) is made of the same material as the casing (4), but in a separate instance the casing upper limiter (6) can be made of a different material. The casing upper limiter (6) is usually a continuation of the upper casing (4) wall. In a separate case, the casing upper limiter (6) can be the continuation of any wall of the casing (4)—the lower or the lateral ones. The purpose of the casing upper limiter (6) is to hold back the part of the inert plate (2), which is thrown away from VERA after the detonation, thus the inert plate (2) acquires a rotating movement and bends at an angle.

Expandable material (8) is a material, which is compressed at the inactive state, is able to use the kinetic energy of the penetrator (7) and, after the contact with the penetrator (7), to suddenly increase its volume. The expandable material (8) can be an expandable rubber, compacted polyethylene, high density non-explosible foam or other natural or synthetic materials. The expandable material (8), after contact with the penetrator (7), expands by increasing its volume, therefore moves away the inert plate (2), which breaks down or diverts the penetrator (7). The expandable material (8) is placed in between the spaces of the plate-shaped elements of the uneven surface inert plate (2) (FIG. 4A). In a separate case it may also be placed in another VERA location.

VERA is mounted on the military vehicle in such a way that the open part of the casing (4) is farthest away from the military vehicle. The open part of the casing (4) is connected to the casing upper limiter (6) and is covered with a casing cover (5). Thus, the penetrator (7) firstly hits the casing cover (5).

The method of operation of the described vertical explosive reactive armor (VERA) is based on the VERA construction. Depending on the inter-position of the explosive material (1), the inert plate (2) and the damping material (3), the different effect by the composing elements on the penetrator (7) is possible and, consequently, the different VERA efficiency could be achieved.

In one of the embodiments, VERA comprises the following parts, looking from the side from which the penetrator (7) arrives: the casing cover (5), the casing upper limiter (6), the open part of the casing (4), the inert plate (2), a layer of explosive material (1), the inert plate (2), a layer of explosive material (1) and the base of the casing (4) (FIG. 1). When the penetrator (7) hits VERA, the penetrator (7) breaks apart the casing cover (5) and the first inert plate (2), which is closest to the casing cover (5) (FIG. 1, A). After hitting the first layer of the explosive material (1), the explosive material (1) detonates as it is common in the case of explosive reactive armor. The first inert plate (2) moves away from VERA after the detonation (FIG. 1, B). The trajectory of the inert plate (2) is very strongly determined by the casing upper limiter (6). The casing upper limiter (6) holds back the upper part of the first inert plate (2), which gives the rotating pendulum movement upwards (FIG. 2, B). The impact time of the first inert plate (2) on the penetrator (7) prolongates. If the penetrator (7) is kinetic, the first inert plate (2) breaks kinetic penetrator (7) into individual elements by its plane and affects the trajectory of the kinetic penetrator (7). Such movement of the first inert plate (2) after detonation strongly reduces the energy of the kinetic penetrator (7), increases the likelihood of the rebound of the remaining part of the penetrator (7), and the likelihood of penetration. If the penetrator (7) is explosively formed penetrator, the first inert plate (2), rotating after the detonation, splashes or partially destroys the current integrity of the penetrator (7) by its plane, which reduces the likelihood of further penetration. If the penetrator (7) is a tandem explosively formed penetrator, the first inert plate (2) after the detonation damages the cartridge of the first penetrator (7) and has the probability of damaging the main cartridge of the explosively formed penetrator (7), i.e., directing the penetrator (7) upwards or damaging the cartridge itself before it is detonated. If a kinetic penetrator (7) or the main cartridge of tandem explosively formed penetrator (7) breaks through the second inert plate (2), the penetrator (7) hits the second layer of the explosive material (1) (FIG. 1, C). When the second layer of the explosive material (1) detonates, the effect is analogous to that of the detonation of the first layer of explosive material (1). If the penetrator (7) is kinetic, the second inert plate (2) breaks the kinetic penetrator (7) into individual elements by its plane and affects the trajectory of the kinetic penetrator (7) or even causes the rebound. Such a movement of the second inert plate (2) after detonation further reduces penetrator's (7) likelihood of penetration. If the penetrator (7) is a tandem explosively formed penetrator (7), the second inert plate (2) after the detonation splashes or partially destroys the current integrity of the main cartridge of the penetrator (7) by its plane, which significantly reduces the likelihood of penetration. In this example (FIG. 1), VERA comprises two layers of explosive material (1) and two inert plates (2), but VERA can comprise a varied number of layers of the explosive material (1) and inert plates (2).

In a different embodiment of the same invention, it could be one or several layers of damping material (3) in between the inert plates (2). In this case, VERA comprises the following parts, looking from the side from which the penetrator (7) arrives: the casing cover (5), the casing upper limiter (6), an open part of the casing (4), the inert plate (2), a layer of the damping material (3), the inert plate (2), a layer of the damping material (3), the inert plate (2), a layer of the explosive material (1), the inert plate (2), a layer of the explosive material (1) and the base of the casing (4) (FIG. 2). In this case, VERA comprises three inert plates (2) and two layers of damping material (3) (FIG. 2, A). When the penetrator (7) hits VERA, the penetrator (7) breaks through the casing cover (5), further breaks through the first, then the second and the third inert plates (2). The casing upper limiter (6) holds back the upper parts of the first inert plates (2), which gives the rotating pendulum movement upwards to the inert plates (2) (FIG. 2, B). In between the inert plates (2) there are two layers of the damping material (3), which partially reduce the sensitivity of the detonation and are needed that the inert plates (2) could slip effectively against each other and could bend at an angle after the contact with the penetrator (7). Such VERA construction effectively protects against the kinetic penetrator (7). The front part of the kinetic penetrator (7) is cut—each inert plate (2) chops the kinetic penetrators (7) into individual elements and affects the trajectory of the kinetic penetrator (7) by bending back and breaking by its plane. In this way, the penetrator (7) is subjected simultaneously to the effects of chopping and rotating between layers of different characteristics, as well as the impact time of the inert plate (2) to the penetrator (7) significantly lengthens. When the penetrator (7) is explosively formed penetrator, the bent back inert plates (2) splash or partially destroy the current integrity of the penetrator (7) by their planes. If the penetrator (7) is a tandem explosively formed penetrator, the bent back inert plates (2) after detonation have the probability to damage both the first and the main cartridge of the tandem explosively formed penetrator (7) (FIG. 2, B). If the main cartridge of the tandem explosively formed penetrator (7) remains undamaged after the first detonation, the penetrator (7) breaks through the fourth (the last) inert plate (2) and hits the second layer of the explosive material (1) (FIG. 2, C). A second layer of the explosive material (1) detonates, and the fourth (the last) inert plate (2) splashes or partially destroys the current integrity of the main cartridge of the penetrator (7) by its plane. If the kinetic penetrator (7) remained undestroyed during the first detonation, it is destroyed during the second detonation. This VERA construction is heavier and larger, but considerably more efficient and enables modernization—allows combining various materials for damping materials (3), explosive materials (1) and inert plate (2) materials.

In another embodiment of the same invention, VERA comprises the following parts, looking from the side from which the penetrator (7) arrives: the casing cover (5), the casing upper limiter (6), an open part of the casing (4), the inert plate (2), a layer of the explosive material (1), the inert plate (2), a layer of the damping material (3), the inert plate (2), a layer of the damping material (3), the inert plate (2), a layer of the explosive material (1) and the base of the casing (4) (FIG. 3). The operation of such VERA is similar as in the case described in FIG. 2. The main difference is in the case of tandem explosively formed penetrator (7). When the first layer of the explosive material (1) detonates, one inert plate (2) bends back, which diverts or disbalances the first cartridge of the explosively formed penetrator (7) (FIG. 3, B). The main cartridge of the explosively formed penetrator (7) is affected by three inert plates (2), which bend back after the detonation of the second layer of the explosive material (1) (FIG. 3, C). In this case, it is a higher probability to effectively damage the main cartridge of the explosively formed penetrator (7). In the case of the kinetic penetrator (7), the effect is analogous to that described in FIG. 2. After the detonations, the inert plates (2) bend back and splash the kinetic penetrator (7) into individual elements and affect the trajectory of the kinetic penetrator (7) by their planes.

In even another embodiment of the same invention, VERA comprises the following parts, looking from the side from which the penetrator (7) arrives: the casing cover (5), the casing upper limiter (6), an open part of the casing (4), the inert plate (2), a layer of the explosive material (1), the expandable material (8), the uneven surface inert plate (2), a layer of the explosive material (1) and the base of the casing (4) (FIG. 4). For the above described cases, the efficiency of VERA depends on the place of the armor, where the penetrator (7) hits. The efficiency of VERA is highest when the penetrator (7) hits as close as possible to the casing upper limiter (6). In this case, an uneven surface inert plate (2) affects the penetrators (7) longer, since the inert plate (2) surface area, which is between the place, where the penetrator (7) hit, and the uneven surface inert plate (2) edge, which bends the most, is larger. When the penetrator (7) hits further from the casing upper limiter (6), the efficiency of VERA is reduced. This problem is solved by VERA construction and plate-shaped elements of uneven surface inert plates (2) (FIG. 4). When the first layer of the explosive material (1) detonates, the first inert plate (2) bends back, which directs or disbalances the first cartridge of the tandem explosively formed penetrator (7) (FIG. 4, B). When the main cartridge of the explosively formed penetrator (7) hits the second layer of the explosive material (1) (FIG. 4C), the upper plate-shaped element of uneven surface inert plate (2) after the detonation leans on the casing upper limiter (6) or the first inert plate (2) and on the wall of the casing (4). Thus, such uneven surface inert plate (2) cannot bend back as a flat surface inert plate (2). The level is formed between the uneven surface inert plate (2) and the wall of the casing (4). The uneven surface inert plate (2) firstly breaks apart the penetrator (7) by moving downward. When the upper plate-shaped element of the uneven surface inert plate (2) leans on the wall of the casing (4), the uneven surface inert plate (2) breaks apart the penetrator (7) by moving upward. This lengthens the path by which the penetrator (7) moves in the inert plate (2), resulting in the increased impact of uneven surface inert plate (2) to the penetrator (7). In addition, the part of the uneven surface inert plate (2), which is farthest from the casing upper limiter (6), is moving by a trajectory which is more distant from the casing upper limiter (6). Therefore, the area of the inert plate (2), affecting the penetrator (7), increases, and the length of movement of the penetrator (7) in an uneven surface inert plate (2) increases, resulting in increased VERA efficiency.

Other embodiments of the same invention are possible, when the position of the inert plate (2), a layer of the explosive material (1), a layer of the damping material (3) and/or the expandable material (8) to each other could be varied or the amount of these elements in VERA construction could be changed. If VERA comprises more than one inert plate (2), a layer of the explosive (1), a layer or the damping material (3), each of these elements may be made of different materials.

VERA can be mounted on vertical, horizontal or inclined surfaces. Since VERA is effective in vertical position, the dimensions of such armor are small, so the dimensions of military vehicle with VERA match the military vehicle standards.

In conclusion, the method of operation of vertical explosive reactive armor can be divided into the following steps:

the penetrator (7) hits VERA;

the penetrator (7) breaks apart the casing cover (5);

the penetrator (7) breaks apart the inert plate (2);

the penetrator (7) hits the layer of the explosive material (1);

the explosive material (1) detonates and throws away the inert plate (2) from VERA;

the casing upper limiter (6) holds back part of the inert plate (2), this gives the rotating pendulum movement upwards to the inert plate (2), which bends at an angle;

the inert plate (2), bent back after the detonation, increases the time of impact by its plane to the penetrator (7), splashes kinetic penetrator (7) to separate elements and affects the trajectory of the remaining part of the kinetic penetrator (7), diverts or disbalances the first cartridge of the explosively formed penetrator (7);

if VERA comprises several layers of explosive material (1) and several inert plates (2), the subsequent inert plates (2), bent back after the second detonation, splash the remaining part of the kinetic penetrator (7) into separate elements, affect the trajectory of the remaining part of the kinetic penetrator (7), direct or disbalance the main cartridge of the explosively formed penetrator (7).

In order to illustrate and describe the invention, the description of the preferred embodiments is presented above. This is not a detailed or restrictive description to determine the exact form or embodiment. The above description should be viewed more than the illustration, not as a restriction. It is obvious that specialists in this field can have many modifications and variations. The embodiment is chosen and described in order to best understand the principles of the present invention and their best practical application for the various embodiments with different modifications suitable for a specific use or implementation adaptation. It is intended that the scope of the invention is defined by the definition added to it and its equivalents, in which all of these definitions have meaning within the broadest limits, unless otherwise stated.

In the embodiments described by those skilled in the art, modifications may be made without deviating from the scope of this invention as defined in the following definition.

What is claimed is:

1. A vertical explosive reactive armor (VERA), designed to protect against penetration of a penetrator, wherein the vertical explosive reactive armor comprises:

a casing comprising an open part, a casing upper limiter and a base;

a casing cover covering at least the open part of the casing, wherein the casing houses:

a first inert plate adjacent to the casing cover, a first layer of explosive material adjacent to the first inert plate, a second inert plate adjacent to the first layer of the explosive material, and a second layer of explosive material adjacent to the second inert plate;

wherein the casing upper limiter, has a plate-shaped form, is situated at the open part of the casing, is mounted to an end of the casing wall to extend therefrom at an angle, to partially cover the first inert plate.

2. The vertical explosive reactive armor according to claim 1, further comprising at least two additional inert plates placed between the first inert plate and the casing cover, wherein a damping material is placed between the two additional inert plates and between one of the additional inert plates and the first inert plate, the damping material comprising a material that reduces the sensitivity of the detonation and helps the inert plates to slip towards each other.

3. The vertical explosive reactive armor according to claim 1, wherein the composition and properties of each inert plate is different.

4. The vertical explosive reactive armor according to claim 1, wherein the composition and properties of each layer of the explosive material is different.

5. The vertical explosive reactive armor according to claim 2, wherein, the composition and properties of each layer of the damping material is different.

6. The vertical explosive reactive armor according to claim 1, wherein the vertical explosive reactive armor is mounted vertically.

7. The vertical explosive reactive armor according to claim 1, wherein the casing upper limiter extends from the end of the casing wall at a 90 degree angle.

8. The vertical explosive reactive armor according to claim 1, wherein the casing comprises an uneven surface inert plate which comprises plate-like elements which define spaces therebetween and which:

are perpendicular to a longitudinal plane of the uneven surface inert plate, are rectangular in shape, and fixed to the longitudinal plane of the uneven surface inert plate at an edge of the plate-shaped elements, and are mounted on a side of the uneven surface inert plate, from which the penetrator arrives.

9. The vertical explosive reactive armor according to claim 8, wherein in between the spaces of the plate-like elements of the uneven surface inert plate further comprising an expandable material comprising a material which is compressed in an inactive state, is configured to utilize the kinetic energy of the penetrator and suddenly increase its volume after contact with the penetrator.

10. A method of operation of the vertical explosive reactive armor according to claim 1, comprising the steps of:

a penetrator hits the vertical explosive reactive armor;

the penetrator breaks apart the casing cover;

the penetrator breaks apart the first inert plate;

the penetrator hits the first layer of the explosive material;

the explosive material detonates and throws away the first inert plate from the vertical explosive reactive armor;

the casing upper limiter holds back a top part of the inert plate to cause a rotating pendulum movement upwards of a bottom part of the inert plate, which moves upwardly at an angle;

wherein the first inert plate, when moved upwards after the detonation, increases a duration of impact on its plane to the penetrator.

* * * * *